US011686036B2

(12) United States Patent
Kim et al.

(10) Patent No.: US 11,686,036 B2
(45) Date of Patent: Jun. 27, 2023

(54) LAUNDRY TREATING DEVICE

(71) Applicant: LG Electronics Inc., Seoul (KR)

(72) Inventors: Woore Kim, Seoul (KR); Beomjun Kim, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 401 days.

(21) Appl. No.: 16/667,172

(22) Filed: Oct. 29, 2019

(65) Prior Publication Data

US 2020/0131690 A1 Apr. 30, 2020

(30) Foreign Application Priority Data

Oct. 30, 2018 (KR) ..... 10-2018-0130769

(51) Int. Cl.

| | |
|---|---|
| ***D06F 39/12*** | (2006.01) |
| ***D06F 39/08*** | (2006.01) |
| ***D06F 39/04*** | (2006.01) |
| ***D06F 103/08*** | (2020.01) |
| ***D06F 58/30*** | (2020.01) |

(Continued)

(52) U.S. Cl.

CPC ..... *D06F 39/12* (2013.01); *D06F 34/14* (2020.02); *D06F 34/26* (2020.02); *D06F 39/04* (2013.01); *D06F 39/083* (2013.01); *D06F 58/16* (2013.01); *D06F 58/26* (2013.01); *D06F 58/30* (2020.02); *D06F 58/38* (2020.02); *D06F 2103/08* (2020.02)

(58) Field of Classification Search

CPC ..... D06F 39/04; D06F 39/045; D06F 39/12; D06F 58/16; D06F 58/26; D06F 58/30; D06F 2103/08; D06F 2103/12; D06F 34/14; D06F 34/26

See application file for complete search history.

(56) References Cited

U.S. PATENT DOCUMENTS 4,986,672 A * 1/1991 Beynon ..... G01J 5/10 374/128
5,172,978 A * 12/1992 Nomura ..... G01J 5/0896 374/130

(Continued)

FOREIGN PATENT DOCUMENTS

CN 1888289 1/2007
CN 101278171 10/2008

(Continued)

OTHER PUBLICATIONS

Machine translation of JP 06-126099 Ato Yoshimoto. (Year: 1994).*

(Continued)

*Primary Examiner* — Joseph L. Perrin
(74) *Attorney, Agent, or Firm* — Fish & Richardson P.C.

(57) ABSTRACT

Disclosed is a laundry treating apparatus. The present invention includes a cabinet, a tub provided within the cabinet, a drum provided within the tub to receive a treatment target therein, the drum made of metallic material, an induction module provided to the tub to heat the drum by induction, an infrared sensor provided to the tub to measure a temperature of the drum, and a barrel lens connected to the infrared sensor so that thermal radiation radiated from the drum enters the barrel lens, wherein the barrel lens includes a guide portion guiding vertically incident thermal radiation to the infrared sensor only.

19 Claims, 5 Drawing Sheets

(51) Int. Cl.

| | |
|---|---|
| ***D06F 58/16*** | (2006.01) |
| ***D06F 58/26*** | (2006.01) |
| ***D06F 34/26*** | (2020.01) |
| ***D06F 34/14*** | (2020.01) |
| *D06F 58/38* | (2020.01) |

(56) References Cited

U.S. PATENT DOCUMENTS

| | | | | |
|---|---|---|---|---|
| 5,396,715 | A * | 3/1995 | Smith | D06F 58/50 34/261 |
| 5,651,192 | A * | 7/1997 | Horwitz | D06F 58/30 34/529 |
| 9,359,706 | B2 * | 6/2016 | Lundbom | D06F 58/50 |
| 9,580,860 | B2 * | 2/2017 | Bellinger | D06F 58/38 |
| 2004/0031924 | A1 * | 2/2004 | Cho | G01J 5/0802 250/353 |
| 2011/0308103 | A1 * | 12/2011 | Bellinger | D06F 58/38 34/497 |
| 2014/0117201 | A1 * | 5/2014 | Barlow | G01J 1/42 250/206 |
| 2018/0057995 | A1 | 3/2018 | Kim et al. | |
| 2018/0148886 | A1 * | 5/2018 | Kalze | D06F 58/34 |
| 2019/0264375 | A1 * | 8/2019 | Park | D06F 58/50 |

FOREIGN PATENT DOCUMENTS

| | | |
|---|---|---|
| CN | 107075780 | 8/2017 |
| DE | 102016110859 | 6/2017 |
| EP | 1111357 | 6/2001 |
| EP | 2400052 | 12/2011 |
| EP | 3315654 | 5/2018 |
| EP | 3315654 A1 | 5/2018 |
| JP | H06126099 | 5/1994 |
| JP | 2010042118 | 2/2010 |
| KR | 20180092762 | 8/2018 |
| KR | 1020180092762 | 8/2018 |
| WO | WO 2014/154431 | 10/2014 |
| WO | WO 2016/037856 | 3/2016 |
| WO | WO2018038580 | 3/2018 |

OTHER PUBLICATIONS

Extended European Search Report in European Application No. 19192773.0, dated Jan. 17, 2020, 9 pages.
International Search Report and Written Opinion in PCT Application No. PCT/KR2019/008404, dated Oct. 11, 2019, 11 pages.
International Search Report in International Appln. No. PCT/KR2019/008404, dated Oct. 11, 2019, 3 pages.
Office Action in Australian Appln. No. 2019369876, dated Mar. 25, 2022, 3 pages.
Office Action in Chinese Appln. No. 201980071431.8, dated Oct. 26, 2022, 14 pages (with English translation).

* cited by examiner

LAUNDRY TREATING DEVICE

CROSS-REFERENCE TO RELATED APPLICATIONS

This application claims priority to Korean Patent Application No. 10-2018-0130769, filed on Oct. 30, 2018, the entire contents of which are hereby incorporated by reference in their entirety.

TECHNICAL FIELD

The present invention relates to a laundry treating device, and more particularly, to an apparatus for treating laundry with an induction heater.

BACKGROUND

Generally, a laundry treating device is a device for washing, drying and/or refreshing laundry. Refreshing means to remove dust of laundry, smooth the creases of laundry, or sterilize laundry using air, steam and the like. Examples of a laundry treating device include a washer, a drier and a refresher. The refresher is a sort of a laundry caring device (or a laundry cleaner) and its product name is called 'Tromm Styler' by LG Electronics, or the like.

A laundry treating device is normally provided with a heater. The heater heats wash water or air, and an electric heater or a gas heater is used in general. Recently, an induction heater configured to heat wash water or air using the principle of induction heating is proposed. The induction heater generates an induced current to heat a conductor.

Generally, an induction heater heats a drum that is a conductor, and wash water, air, laundry or the like is heated by the heated drum. Therefore, to prevent a drum from being overheated in a laundry treating device employing an induction heater, it is preferable that the temperature of the drum is accurately measured. However, since a drum is a rotated part by being provided within a tub, it is difficult to measure the temperature of the drum accurately. Thus, the demand for ways to accurately measure the temperature of the drum is rising.

SUMMARY

Accordingly, embodiments of the present invention are directed to a laundry treating apparatus that substantially obviates one or more problems due to limitations and disadvantages of the related art.

One object of the present invention is to provide a laundry treating apparatus capable of measuring the temperature of a drum accurately.

Another object of the present invention is to provide a laundry treating apparatus capable of preventing contamination of a sensor that measures the temperature of a drum.

Further object of the present invention is to provide a laundry treating apparatus capable of decontamination of a sensor that measures the temperature of a drum.

Technical tasks obtainable from the present invention are non-limited by the above-mentioned technical tasks. And, other unmentioned technical tasks can be clearly understood from the following description by those having ordinary skill in the technical field to which the present invention pertains.

The present invention provides a non-contact type temperature sensor (e.g., an infrared sensor) installed at a tub to measure a temperature of a drum. The present invention is provided with a noise prevention structure to measure a radiometric quantity of a drum by the infrared sensor. The noise prevention structure may include a barrel lens having a guide part that guides the radiometric quantity of the drum to the infrared sensor. The present invention provides a contamination prevention cap to prevent contamination of the barrel lens. The present invention includes a barrel lens provided to a prescribed location of the tub corresponding to a dewatering hole of the drum to decontaminate the barrel lens.

Additional advantages, objects, and features of the invention will be set forth in the disclosure herein as well as the accompanying drawings. Such aspects may also be appreciated by those skilled in the art based on the disclosure herein.

To achieve these objects and other advantages and in accordance with the purpose of the invention, as embodied and broadly described herein, an apparatus for treating laundry according to one embodiment of the present invention may include a cabinet, a tub provided within the cabinet, a drum provided within the tub to receive a treatment target therein, the drum made of metallic material, an induction module provided to the tub to heat the drum by induction, an infrared sensor provided to the tub to measure a temperature of the drum, and a barrel lens connected to the infrared sensor so that thermal radiation radiated from the drum enters the barrel lens, wherein the barrel lens includes a guide portion guiding vertically incident thermal radiation to the infrared sensor only.

Preferably, the guide portion may have a cylindrical shape and an axis of the cylindrical shape may be aligned with that of the infrared sensor.

More preferably, a tap having prominences and depressions may be provided to an inside of the guide portion.

More preferably, the guide portion may include a recessed portion provided to a top side of the guide portion so as to have the infrared sensor coupled thereto.

And, the guide portion may further include an expanding portion provided to a bottom side of the guide portion so that the thermal radiation enters the expanding pipe portion.

Moreover, a diameter of the guide portion may be smaller than that of the barrel lens, one end of the expanding portion may correspond to the diameter of the guide portion, and the other end of the expanding portion may be greater than a diameter of the one end.

More preferably, a diameter of the guide portion may correspond to a diameter of an entrance of the infrared sensor.

And, a contamination preventing cap may be provided to a fore-end of the barrel lens.

Moreover, the contamination preventing cap may be provided to a fore-end of the expanding portion to open/close the expanding portion and made of infrared-transmissive material.

And, the barrel lens may be provided to a position corresponding to a vicinity of a center of a rotation shaft of the drum in the tub, and more preferably, to a vicinity of a rotation shaft center of the drum in the tub.

In another aspect of the present invention, as embodied and broadly described herein, an apparatus for treating laundry according to another embodiment of the present invention may include a cabinet, a tub provided within the cabinet, a drum provided within the tub to receive a treatment target therein, the drum made of metallic material, an induction module provided to the tub to heat the drum by induction, an infrared sensor provided to the tub to measure a temperature of the drum, and a barrel lens connected to the infrared sensor so that thermal radiation radiated from the drum enters the barrel lens, wherein the barrel lens is provided to a position corresponding to a dewatering hole of the drum in the tub.

Preferably, the barrel lens may be provided to a position corresponding to a vicinity of a center of a rotation shaft of the drum in the tub, and more preferably, within 20 mm right and left apart from the center of the rotation shaft of the drum in the tub. The respective features of the aforementioned embodiment can be complexly implemented in other embodiments unless contradictory or exclusive.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

Accordingly, an apparatus for treating laundry according to the present invention provides the following effects and/or features.

First of all, according to the present invention, the temperature of a drum can be accurately measured advantageously.

Secondly, according to the present invention, contamination of a sensor that measures the temperature of a drum can be prevented advantageously.

Thirdly, according to the present invention, a sensor that measures the temperature of a drum can be decontaminated.

Effects obtainable from the present invention may be non-limited by the above mentioned effect. And, other unmentioned effects can be clearly understood from the following description by those having ordinary skill in the technical field to which the present invention pertains.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

A laundry treating device according to an embodiment of the present invention will be described with reference to the accompanying drawings. Description will now be given in detail according to specific embodiments disclosed herein, with reference to the accompanying drawings. Yet, the embodiments and drawings are used to help the understanding of the present invention. Moreover, to help the understanding of the present invention, the accompanying drawings may be illustrated in a manner of exaggerating sizes of some components instead of using a real scale. Thus, the present invention is non-limited to the following embodiment, and it is intended that the present invention covers the modifications and variations of this invention provided they come within the scope of the appended claims and their equivalents.

Figure 1:
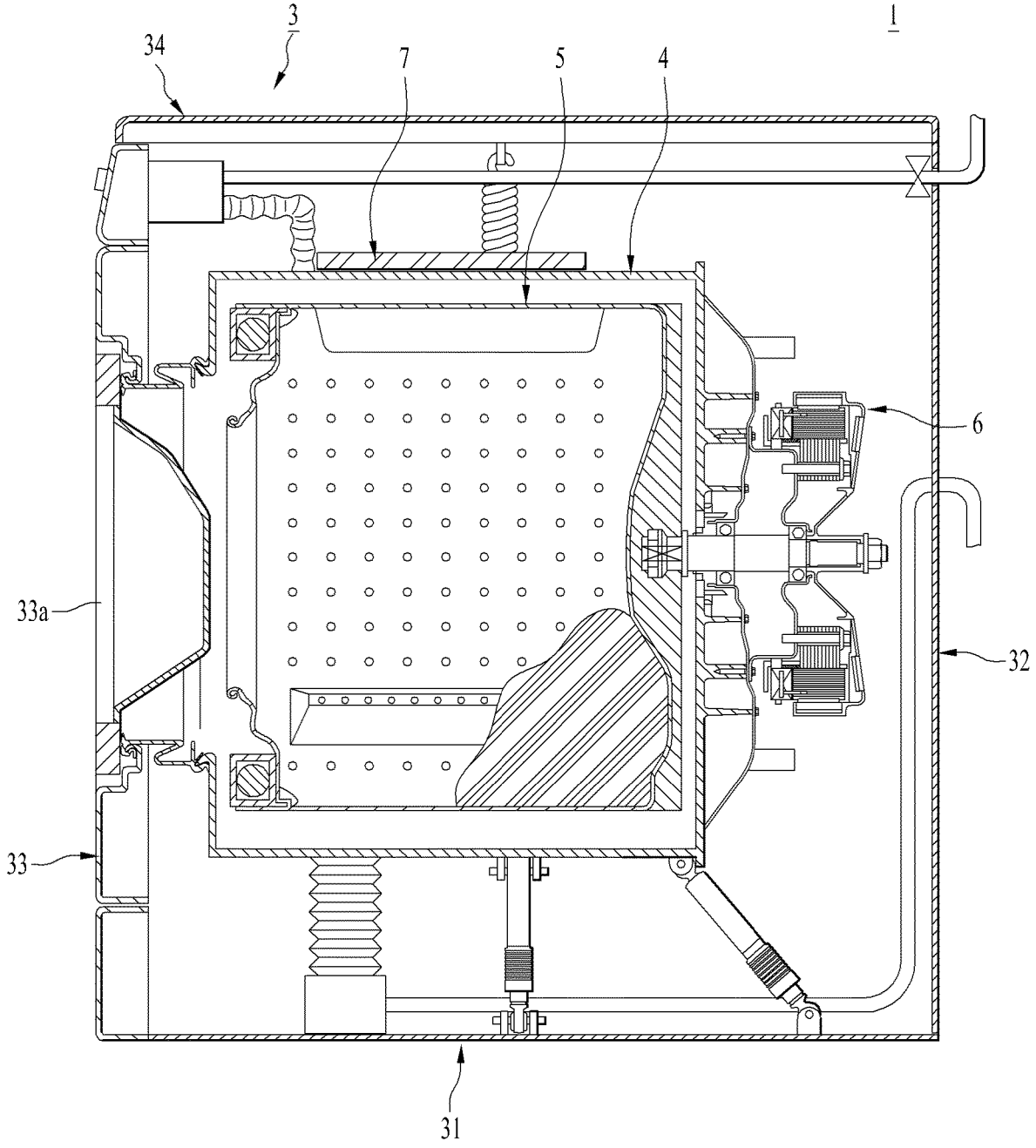
FIG. 1 is a longitudinal section diagram showing a general laundry treating device schematically.

First of all, an overall structure of a laundry treating device according to an embodiment of the present invention is described with reference to FIG. 1. In the following, a washer 1 will be taken as an example of the laundry treating device.

A tub 4 is provided within a cabinet 3. A drum 5 is rotatably provided within the tub 4. And, a motor 6 configured to rotate the drum 5 may be provided to a rear side of the tub 4.

Meanwhile, the cabinet 3 preferably includes a base 31, a front panel 33, a rear panel 32, a side panel (not shown) and a top panel 34. A door 33*a* is preferably provided to the front panel 33.

Meanwhile, an induction heater 7 may be provided to a prescribed position, and more preferably, to an outside of the tub 4. The drum 5 is preferably made of conductor, e.g., metal material. The induction heater 7 heats the drum 5 by induction and wash water and/or air is heated by the heated drum 5.

Particularly, an induction module may be provided to the tub 4 so as to have a spaced interval with a circumferential surface of the drum 5. The induction module conceptually includes the induction heater 7, whereby the circumferential surface of the drum 5 can be heated through the magnetic field generated from applying a current to a wire-winding coil.

Meanwhile, a temperature sensor configured to measure a temperature of the drum 5 is preferably provided to a prescribed position on the tub 4.

Figure 2:
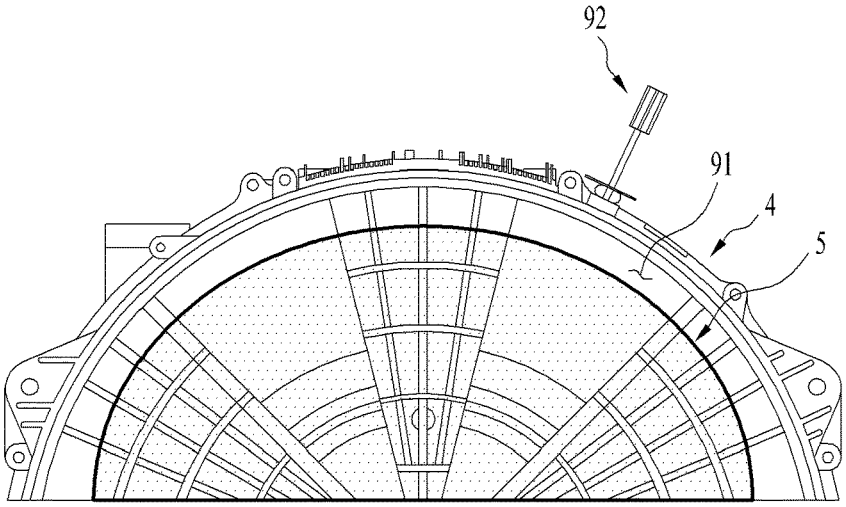
FIG. 2 is a cross-sectional diagram schematically showing a laundry treating apparatus according to one embodiment of the present invention.

A temperature sensor according to one embodiment of the present invention is described with reference to FIG. 2.

The reason why a temperature sensor configured to measure a temperature of the drum 5 is provided to the tub instead of being directly provided to the drum 5 is described as follows. First of all, the drum 5 is provided within the tub 4 and rotated generally in the course of washing, rinsing, dewatering, drying and the like. As it is not easy to directly install the temperature sensor configured to measure a temperature of the drum 5 at the drum 5 in direct, the temperature sensor is preferably provided to the tub 4.

The temperature sensor may include a contact type temperature sensor, e.g., a thermistor 92. The thermistor 92 measures a temperature of the drum 5 indirectly by measuring an air temperature around the drum 5 instead of directly measuring a temperature of the drum 5. Once the drum 5 is heated, air between the drum 5 and the tub 4 is heated as well. The thermistor 92 measures the temperature of the air between the drum 5 and the tub 91, thereby measuring the temperature of the drum 5 in direct.

According to such mechanism, a time difference is generated between the temperature of the drum 5 and the temperature measured by the thermistor 92. Namely, if the drum 5 is heated, air around the drum 5 is heated and the thermistor 92 measures the temperature of the air. Moreover, in case that the drum 5 is heated locally, the thermistor 92 has difficulty in measuring the locally heated temperature. The reason for this is that the thermistor 92 measures an average temperature of the air in a space 91 between the drum 5 and the tub 4. Moreover, since the temperature of the air between the drum 5 and the tub 4 is affected by condensate water, drying load and the like as well as by the temperature of the drum 5, the temperature measured by the thermistor 92 may have a difference from a real temperature of the drum 5.

Figure 3:
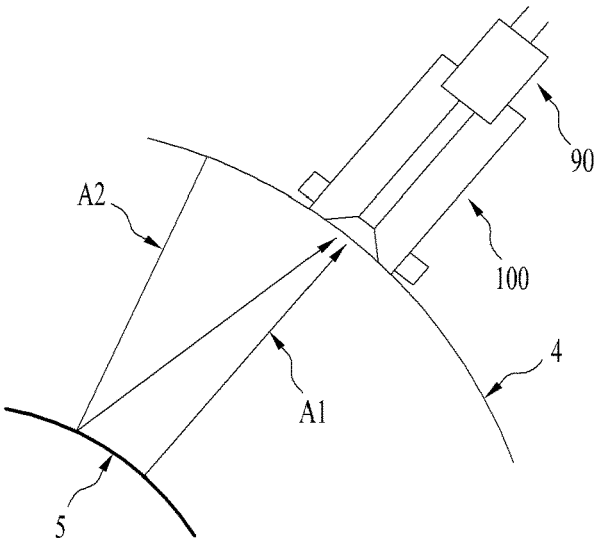
FIG. 3 is a conceptual diagram schematically showing a laundry treating apparatus according to another embodiment of the present invention.

A temperature sensor according to another embodiment of the present invention is described with reference to FIG. 3.

The present embodiment proposes to directly measure a temperature of the drum 5 using a non-contact type sensor, e.g., a temperature sensor using infrared (hereinafter 'infrared sensor' or 'IR sensor').

Description will now be given in detail as follows.

An IR sensor 90 measures a temperature using thermal radiation radiated by material. The IR sensor 90 is provided to the tub 4 and directly measures a temperature of the drum 5 using the IR sensor 90.

The IR sensor 90 directly measures a temperature of the drum 5 by measuring a radiometric quantity A1 of the drum 5. Hence, if the IR sensor 90 is used, it is able to eliminate a time difference between the temperature of the drum 5 and the temperature measured by the IR sensor 90. Moreover, if the IR sensor 90 is used, it is able to measure a local temperature of the drum 5 that is being rotated.

Meanwhile, if the IR sensor 90 is provided to the tub 4, as a temperature of the tub 4 is measured by the IR sensor 90 as well as a temperature of the drum 5, error may be generated. This is because a radiometric quantity A2 of the tub 4 may be measured by the IR sensor 90 as well as the radiometric quantity A1 of the drum 5. Hence, in case of using the IR sensor 90, it will be preferable that a structure capable of measuring the radiometric quantity of the drum 5 only is provided if possible.

When a temperature of the drum 5 is measured, a radiometric quantity coming from an ambient environment, e.g., the radiometric quantity A2 of the tub is a sort of thermal noise as well as the radiometric quantity A1 of the drum 5. Hence, it is preferable to employ a noise prevention structure capable of preventing such noise from entering the IR sensor 90. As one example of the noise prevention structure, it is able to use a barrel lens that absorbs or reflects noise. For example, a barrel lens 100 may be provided to an entrance of the IR sensor 90.

Figure 4:
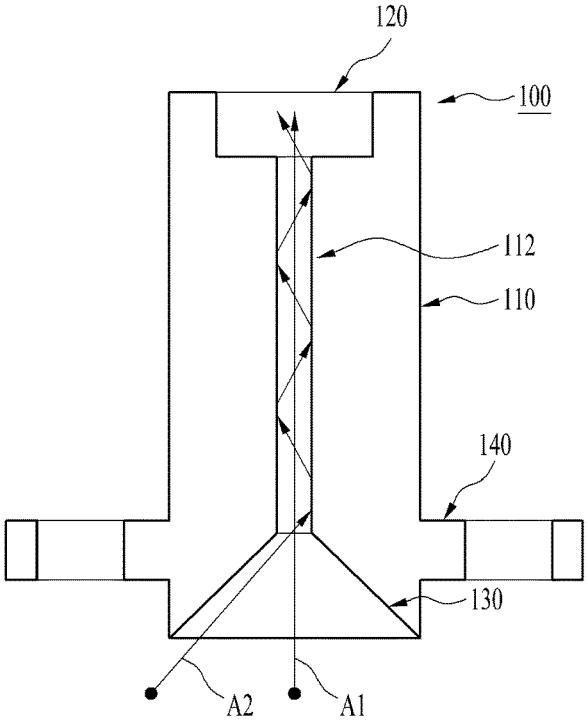
FIG. 4 is a cross-sectional diagram of a barrel lens shown in FIG. 3.

The barrel lens 100 is described with reference to FIG. 4 as follows.

First of all, a body 110 having a guide portion 112 guiding thermal radiation to the IR sensor 90 is preferably provided to the barrel lens 100. By the guide portion 112, only a radiometric quantity coming in straight to the guide portion 112 is allowed to enter the IR sensor 90. Yet, a radiometric quantity failing to come in straight is not allowed to enter the IR sensor 90 by the guide portion 112. Hence, for example, a central axis of the guide portion 112 is preferably aligned with a central axis of the IR sensor 90.

The guide portion 112 may include a hollow pipe in a cylindrical shape having a small diameter. A size of the guide portion 112 preferably corresponds to a size of the entrance of the IR sensor.

Meanwhile, a recessed portion 120 to which the IR sensor is coupled is provided to a top side of the guide portion 112 and an expanding portion 130 may be provided to a bottom side of the guide portion 112. The recessed portion 120 preferably has a shape corresponding to a shape of an entrance side of the IR sensor. And, a diameter of the recessed portion 120 is preferably greater than that of the guide portion 112. Moreover, the expanding portion 130 may be in a shape having a wide entrance in which thermal radiation flows and a narrow exit.

Meanwhile, a coupling portion 140 for coupling the barrel lens 100 to the tub 4 may be provided to a lower part of the body 110. Hence, the barrel lens 100 can be coupled to the tub 4 using a screw and the like.

Operation of the barrel lens 100 is described with reference to FIG. 3 and FIG. 4 as follows.

First of all, the IR sensor 90 and the barrel lens 100 may be disposed toward the drum 5. Hence, thermal radiation A1 radiated from a prescribed position of the drum 5, i.e., the drum 5 located under the barrel lens 100 is vertically incident on the guide portion 112 and then arrives at the IR sensor 90. Hence, by the thermal radiation radiated from the drum 5, the IR sensor 90 can measure a temperature of the drum 5.

On the contrary, noise other than the thermal radiation radiated from the drum 5, e.g., thermal radiation A2 of the tub is incident on the guide portion 112 with a prescribed inclination instead of being vertically incident. The thermal radiation incident on the guide portion 112 with the prescribed inclination proceeds by repeating reflections in the guide portion 112 and is finally inclined instead of going straight to the entrance of the IR sensor 90. Therefore, the noise can avoid being sensed by the IR sensor 90.

Figure 5:
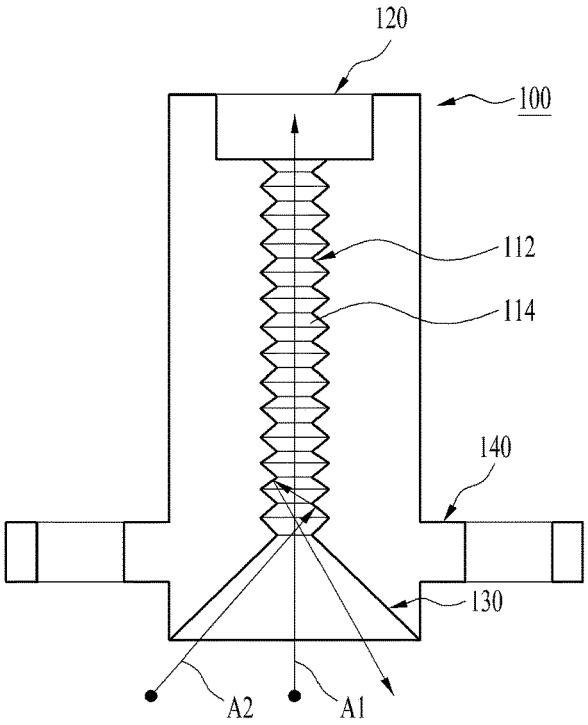
FIG. 5 is a cross-sectional diagram showing a modified example of FIG. 4.

Another embodiment of the barrel lens 100 is described with reference to FIG. 5 as follows.

First of all, the above-described barrel lens 100 can prevent noise from being measured by the IR sensor 90 but has difficulty in completely preventing the noise. Therefore, the present embodiment proposes a structure capable of further eliminating noise.

The barrel lens of the present embodiment has the structure similar to that of the former barrel lens of the aforementioned embodiment. Yet, according to the present embodiment, a tap 114 is provided to the guide portion 112 of the barrel lens 100. The tap 114 may be formed in a shape of a multitude of prominences and depressions. Namely, the thermal radiation (noise) failing to be incident on the guide portion 112 by going straight repeats reflections in the tap 114. In doing so, the thermal radiation is guided to be reflected out of the guide portion 112 by the shape of the prominences and depressions 114.

As described above, the noise incident on the guide portion 112 is externally reflected by the tap 114 again so as not to arrive at the IR sensor. Hence, it is able to effectively prevent the external noise from arriving at the IR sensor 90. In order to have the external noise reflected out of the guide portion 112, the shapes, sizes, numbers and the like of the tap 114 can be appropriately determined through test and simulations.

Figure 6:
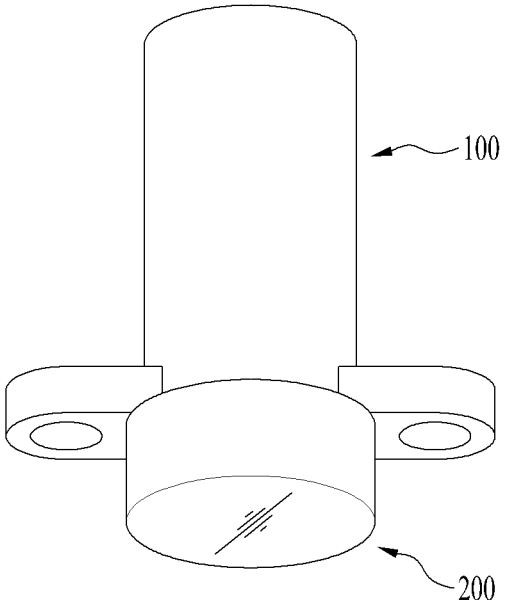
FIG. 6 is a perspective diagram showing a modified example of a barrel lens shown in FIG. 3 and FIG. 4.

In the following, an embodiment of a structure for preventing contamination of the barrel lens 100 is described with reference to FIG. 6.

To prevent the contamination of the barrel lens 100, a cap 200 is preferably provided to an entrance side of the barrel lens 100. The cap 200 blocks the entrance of the body 110, thereby playing a role in preventing external particles or alien substance from coming into the body 110, and more particularly, into the guide portion 112. A shape of the cap 200 is non-limited if such a function is achieved.

Yet, since a fore-end of the barrel lens 100 has a cylindrical shape, the shape of the cap 200 preferably has a cylindrical shape. And, the cap 200 is preferably made of infrared-transmissive material.

Figure 7:
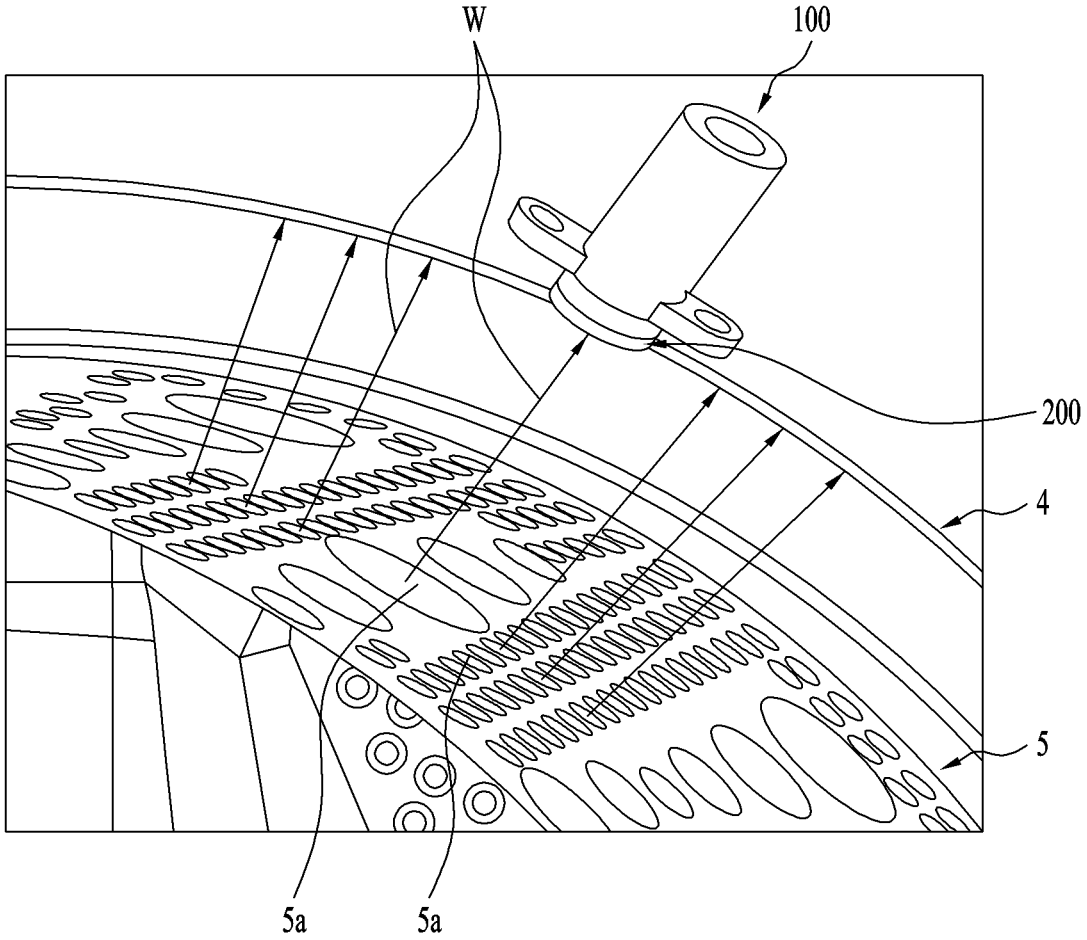
FIG. 7 is a perspective diagram to describe an installed location of a temperature sensor shown in FIG. 3.

An installation position of the barrel lens 100 is described with reference to FIG. 7 as follows.

First of all, as described above, the drum 5 is a component that is rotated. Hence, the IR sensor or the barrel lens 100 is preferably provided to the tub 4 that is not rotated.

A preferable installation position of the IR sensor or the barrel lens 100 is described in detail as follows. In the following, an installation position of the IR sensor provided with the barrel lens 100 is described.

Although the cap 200 for contamination prevention is provided to the barrel lens 100, as a use time elapses, contamination may be accumulated on the cap 200. Hence, it is preferable to remove the contamination of the cap 200. To this end, a following method is proposed.

During an operation of a laundry treating device, and more particularly, in the course of dewatering, water W in the drum 5 is discharged in a direction of the tub 4 through dewatering holes 5*a* of the drum 5 by a centrifugal force. The cap 200 is preferably provided to a position of the tub 4 corresponding to the dewatering holes 5*a*. If so, it is able to remove the contamination attached to the cap 200 using the water W discharged through the dewatering holes 5*a*.

Meanwhile, the IR sensor can measure a local temperature of the drum 5. Hence, the IR sensor is preferably installed at a position for measuring a maximum temperature of the drum. Thus, the barrel lens 100 is preferably provided to an area of the tub 4 corresponding to a maximum temperature area of the drum 5. For example, the drum 5 normally has a maximum temperature near a center in an axial direction. Correspondingly, it is preferable that the barrel lens 100 is provided near a center in an axial direction of the tub 4, and more preferably, within about 20 mm right and left apart from the center.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

For example, although an IR sensor is described as a non-contact type sensor in an embodiment of the present invention, the principle of the present invention is applicable to other non-contact type sensors. Moreover, although a washer is taken as an example for description, the principle of the present invention is also applicable to a drier, a refresher, etc.

Although an IR sensor is described as a non-contact type sensor in an embodiment of the present invention for example, the principle of the present invention is applicable to other non-contact type sensors. Moreover, although a washer is taken as an example for description, the principle of the present invention is also applicable to a drier, a refresher, etc.

What is claimed is:

1. An apparatus for treating laundry, comprising:

a cabinet;

a tub disposed in the cabinet;

a drum disposed in the tub and configured to receive laundry therein, the drum having a circumferential surface made of a metallic material;

a motor configured to rotate the drum;

an induction module that is disposed at the tub and radially spaced apart outward from the circumferential surface of the drum, the induction module being configured to heat the drum by induction;

an infrared sensor disposed at the tub outside the drum, the infrared sensor having an entrance that faces the circumferential surface of the drum to measure a temperature of the drum; and a barrel lens that is connected to the infrared sensor and has a hollow extending in a radial direction of the drum, wherein a diameter of the hollow corresponds to a diameter of the entrance of the infrared sensor.

2. The apparatus of claim 1, wherein the hollow of the barrel lens and the infrared sensor are coaxial.

3. The apparatus of claim 2, further comprising a tap that is disposed at the hollow of the barrel lens and that comprises prominences and depressions.

4. The apparatus of claim 2, further comprising a recessed portion that is defined at a top side of the hollow of the barrel lens facing away from the drum and that is configured to seat the infrared sensor.

5. The apparatus of claim 4, further comprising an expanding portion that is disposed at a bottom side of the hollow of the barrel lens facing the drum and that is configured to introduce thermal radiation from the drum to the hollow of the barrel lens.

6. The apparatus of claim 5, wherein the diameter of the hollow of the barrel lens is less than a diameter of an outer surface of the barrel lens, wherein a diameter of a first end of the expanding portion corresponds to the diameter of the hollow of the barrel lens, and wherein a diameter of a second end of the expanding portion is greater than the diameter of the first end of the expanding portion.

7. The apparatus of claim 5, further comprising a cap disposed at a front end of the barrel lens facing the drum and configured to reduce contamination of the barrel lens.

8. The apparatus of claim 7, wherein the cap is configured to be positioned at a front end of the expanding portion and to open and close the expanding portion, and wherein the cap is made of an infrared-transmissive material.

9. The apparatus of claim 7, wherein the barrel lens is disposed within a range from a position corresponding to a center of a rotation shaft of the drum.

10. The apparatus of claim 9, wherein the barrel lens is disposed within 20 mm from the position corresponding to the center of the rotation shaft of the drum.

11. The apparatus of claim 1, wherein a front surface of the barrel lens faces the circumferential surface of the drum.

12. The apparatus of claim 1, wherein the hollow of the barrel lens is configured to barrel lens, to an outside of the infrared sensor, a portion of thermal radiation that is incident to the hollow of the barrel lens in a direction inclined with respect to the radial direction of the drum.

13. The apparatus of claim 1, wherein the drum defines a dewatering hole configured to discharge water to an inner surface of the tub, and wherein the barrel lens is disposed at a position of the tub facing the dewatering hole of the drum.

14. The apparatus of claim 13, wherein the barrel lens is disposed within a range from a position of the tub corresponding to a center of a rotation shaft of the drum.

15. The apparatus of claim 14, wherein the barrel lens is disposed within 20 mm from the position of the tub corresponding to the center of the rotation shaft of the drum.

16. The apparatus of claim 13, further comprising a cap disposed at a front end of the barrel lens facing the dewatering hole of the drum and configured to reduce contamination of the barrel lens by water discharged from the dewatering hole of the drum.

17. The apparatus of claim 16, wherein at least a portion of the cap is inserted into the tub and configured to contact the water discharged from the dewatering hole of the drum.

18. The apparatus of claim 1, wherein the hollow has a cylindrical shape and is surrounded by an inner surface of the barrel lens.

19. The apparatus of claim 1, wherein the barrel lens is in contact with the infrared sensor.

* * * * *